US007108602B2

(12) United States Patent
Daly

(10) Patent No.: US 7,108,602 B2
(45) **Date of Patent: *Sep. 19, 2006**

(54) MULTI-REEL SLOT MACHINE WITH SELECTABLE REEL PLAY

(75) Inventor: Terence Gerard Daly, Las Vegas, NV (US)

(73) Assignee: Bally Gaming International, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/088,482

(22) Filed: Mar. 24, 2005

(65) Prior Publication Data

US 2005/0164777 A1 Jul. 28, 2005

Related U.S. Application Data

(63) Continuation of application No. 10/616,264, filed on Jul. 8, 2003, now Pat. No. 6,896,617.

(51) Int. Cl.
*A63F 9/24* (2006.01)

(52) U.S. Cl. ..... 463/20; 273/143 R

(58) Field of Classification Search ..... 463/20; 273/143 R

See application file for complete search history.

(56) References Cited

U.S. PATENT DOCUMENTS

| | | | | |
|---|---|---|---|---|
| 4,695,053 | A * | 9/1987 | Vazquez et al. | 463/18 |
| 4,836,546 | A | 6/1989 | DiRe et al. | |
| 5,704,835 | A | 1/1998 | Dietz, II | |
| 5,775,692 | A | 7/1998 | Watts et al. | |
| 5,935,002 | A | 8/1999 | Falciglia | |
| 6,015,346 | A | 1/2000 | Bennett | |
| 6,062,980 | A | 5/2000 | Luciano | |
| 6,068,552 | A * | 5/2000 | Walker et al. | 463/21 |
| 6,120,378 | A | 9/2000 | Moody et al. | |
| 6,159,095 | A | 12/2000 | Frohm et al. | |
| 6,270,412 | B1 | 8/2001 | Crawford et al. | |
| 6,379,245 | B1 | 4/2002 | De Keller | |
| 2001/0046890 | A1 | 11/2001 | Ferguson | |
| 2001/0054794 | A1 | 12/2001 | Cole et al. | |
| 2002/0014740 | A1 | 2/2002 | Alnsworth | |
| 2002/0055381 | A1 | 5/2002 | Tarantino | |

FOREIGN PATENT DOCUMENTS

GB 2097160 A * 10/1982

* cited by examiner

*Primary Examiner*—Robert Olszewski
*Assistant Examiner*—Kesha Y. Frisby
(74) *Attorney, Agent, or Firm*—Brown Raysman Millstein Felder & Steiner LLP

(57) ABSTRACT

A reel spinning gaming device 10 includes a plurality of selectable reels 20 each having game symbols 30 located thereon, a selection system 40, and an actuating system 50. Each reel displays an outcome symbol 30 after having been spun. The selection system 40 designates a subset of the selectable reels as the initial active reels 70 for the initial game. The actuating system 50 then spins the initial active reels 70, after which a prize may be awarded dependent upon the combination of the outcome symbols 30 from the initial active reels 70. The selection system 40 then designates a new subset of the selectable reels 20 as the active reels 70 for each subsequent consecutive game by substituting a non-active reel from the previous game with an active reel from the previous game. The actuating system 50 then spins the newly substituted active reel.

41 Claims, 9 Drawing Sheets

MULTI-REEL SLOT MACHINE WITH SELECTABLE REEL PLAY

RELATED APPLICATIONS

This application is a continuation of U.S. patent application Ser. No. 10/616,264 filed Jul. 8, 2003 now U.S. Pat. No. 6,896,617, entitled MULTI-REEL SLOT MACHINE WITH SELECTABLE REEL PLAY, which is hereby incorporated herein by reference.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

This invention relates generally to a reel spinning game, and more particularly, to a reel spinning game wherein a subset of reels is selected from a plurality of reels, the subset of reels being spun in an initial game, after which a reel from the subset is replaced with a reel not already included in the current subset, and that replacement reel is spun in the next game.

BACKGROUND OF THE INVENTION

In a traditional reel-spinning slot machine, each spin of the reels is typically a separate and distinct game, which has no relationship with any prior or future game played on that machine. As such, there is a need for a game that will increase player excitement and maintain player interest between consecutive games. To address this issue, several different types of "second chance" games have been developed that try to maintain player interest from a first game segment to a second game segment by providing the player with another opportunity to win.

For example, some slot machines allow a player to "nudge" one of the reels so that a displayed symbol is replaced by an adjacent symbol on the reel. The success or failure of the game is then recalculated based upon the new symbol combination appearing after the reel has been nudged. While this nudging feature does address the issue of being one symbol short of a winning combination, it provides only limited relief. There is a continuing need for other slot machine variants that provide at least a "second chance" (or more) for a player to achieve a win, after initially achieving a win or a near win in a prior game, thereby maintaining player excitement between individual games.

Accordingly, it is desirable to provide a player with options for playing additional games that maintain some portion of the outcome symbol combination from the previous game, thus, avoiding the need for the player to start completely over with each new game. Further, there is a continuing need for a gaming machine that provides a player with the opportunity to overcome at least some of the frustration of being just short of a winning combination. Accordingly, those skilled in the art have long recognized the need for a gaming machine that addresses these issues. The present invention clearly fulfills these and other needs.

SUMMARY OF THE INVENTION

Briefly, and in general terms, a preferred embodiment resolves the above and other problems by providing a reel spinning gaming device that allows a player to play multiple games. Each spin of the reels constitutes a complete game. The gaming device includes a plurality of selectable reels, a selection system, an actuating system, a prize controller, and a reselection system. The selectable reels each have symbols located on their periphery, such that each selectable reel displays an outcome symbol after being spun. The selection system is operatively associated with each selectable reel and is used to designate a subset of the selectable reels as the initial active reels for an initial game. The actuating system is operatively associated with the selectable reels and spins the initial active reels to achieve an outcome symbol combination for the initial game. The prize controller makes a prize determination as to whether a prize is to be awarded based upon the outcome symbol combination of the initial game.

The reselection system then substitutes a previously non-active reel for an active reel from the initial game, thereby designating a new set of active reels for a second game. This new set of active reels for the second game includes the newly substituted active reel and the remaining active reels. The newly substituted active reel is spun for the second game while the remaining active reels are not spun for the second game. The outcome symbol from the newly substituted active reel is used in conjunction with the outcome symbols from the remaining active reels to produce an outcome symbol combination for the second game. The prize controller then performs a prize determination for the second game.

In some preferred embodiments, the reselection system of the gaming device further substitutes a non-active reel for an active reel from the second game, thereby designating a new set of active reels for a third game. This new set of active reels for the third game includes a newly substituted active reel and remaining active reels. The newly substituted active reel is spun for the third game while the remaining active reels are not spun for the third game. The outcome symbol from the newly substituted active reel is used in conjunction with the outcome symbols from the remaining active reels to produce an outcome symbol combination for the third game. The prize controller then performs a prize determination for the third game. This substitution, designation, and spinning of active reels, and the prize determination of the outcome symbol combinations produced in association therewith, is repeated for any additional games until a predetermined criteria has been satisfied or until all games purchased by the player have been completed.

For example, in one preferred embodiment of a gaming device having fourteen selectable reels, numbered one through fourteen, an initial game is played by spinning reels one through five, which are designated as the initial active reels in the first game. The prize controller makes a prize determination as to whether a prize is to be awarded based upon the outcome symbols of the initial active reels in the first game. The second game then begins in which reel number one becomes a non-active reel, reel number six becomes a newly substituted active reel, and reels two through five become the remaining active reels for the second game. The newly substituted active reel (i.e., reel six) is spun in the second game while the remaining active reels (i.e., reels two through five) are not spun in the second game. The prize controller makes a prize determination as to whether a prize is to be awarded based upon the outcome symbol from the newly substituted active reel (i.e., reel six) that was just spun in the second game and outcome symbols from the remaining active reels (i.e., reels two through five) that were not spun in the second game.

Following this same example, the third game then begins in which reel number two becomes a non-active reel, reel number seven becomes a newly substituted active reel, and reels three through six become the remaining active reels for the third game. The newly substituted active reel (i.e., reel seven) is spun in the third game while the remaining active reels (i.e., reels three through six) are not spun in the third game. The prize controller makes a prize determination as to whether a prize is to be awarded based upon the outcome symbol from newly substituted active reel (i.e., reel seven) that was just spun in the third game and the outcome symbols from the remaining active reels (i.e., reels three through six) that were not spun in the third game. This process is repeated for any additional games until a predetermined criteria has been satisfied or until all games purchased by the player have been played.

In one preferred embodiment, the reselection system substitutes more than one of the non-active reels for more than one of the active reels when designating a new subset of the selectable reels as the active reels for a subsequent game. Further, in one preferred embodiment, the substitution of a non-active reel for an active reel comprises shifting the selectable reels that are designated as active reels to the left by one reel within the plurality of selectable reels. In yet another embodiment, the substitution of a non-active reel for an active reel comprises shifting the selectable reels that are designated as active reels to the right by one reel within the plurality of selectable reels. In still another embodiment, the substitution of a non-active reel for an active reel comprises randomly selecting the reels that are designated as active reels among the plurality of selectable reels.

In one preferred embodiment, the reselection system that substitutes the non-active reels for the active reels is player controlled, while in another preferred embodiment, the reselection system that substitutes non-active reels for active reels is computer controlled. Additionally, in one preferred embodiment, the selectable reels are mechanical components, while in another preferred embodiment the selectable reels are video components. Further, in still another preferred embodiment, the selectable reels include both mechanical and video reels.

In one aspect of a preferred embodiment, the active reels are designated as active by highlighting the active reels. In another preferred aspect, the active reels are designated as active by de-emphasizing the non-active reels. Moreover, the designation of selectable reels as active reels may also be accomplished by dropping the non-active reels off of the display screen (or window), or otherwise removing the non-active reels from the player's view.

In another preferred embodiment, the active reels are juxtapositioned within the plurality of selectable reels. However, in another preferred embodiment, the active reels are non-contiguous within the plurality of selectable reels. In still another embodiment, the actuating system spins only the initial active reels in the initial game, and spins only the newly substituted active reel in each subsequent consecutive game. In yet another preferred embodiment, the actuating system spins all of the plurality of selectable reels in the initial game, though only the outcome symbol combination from the initial active reels is used by the prize controller to provide a prize determination. This spinning of non-active reels is designed to tempt the player with the allure of other possible outcomes, had other of the non-active reels been designated as the initial active reels. Correspondingly, in each following game the actuating system spins all of the plurality of selectable reels except for the remaining active reels, but only the outcome symbol from the newly substituted active reel of each game in conjunction with outcome symbols from the remaining active reels are used by the prize controller to make a prize determination in each game.

A preferred embodiment is also directed towards a reel-spinning gaming device that includes: a plurality of selectable reels having symbols thereon, wherein each selectable reel displays an outcome symbol after being spun; means for accepting a wager from a player to purchase game play, wherein each reel spin constitutes a game; means for selecting a subset of the plurality of selectable reels as initial active reels in an initial game; means for spinning the initial active reels to achieve an outcome symbol combination in the initial game; means for making a prize determination based upon the outcome symbol combination, and awarding a prize, if appropriate, in the initial game; means for substituting a non-active reel for an active reel from the initial game, thereby designating a new set of active reels for a second game, the new set of active reels for the second game including a newly substituted active reel and remaining active reels; means for spinning, for the second game, the newly substituted active reel to achieve an outcome symbol; and means for making a prize determination based upon the outcome symbol from the newly substituted active reel in conjunction with the outcome symbols from the remaining active reels, and awarding a prize, if appropriate, in the second game.

In some preferred embodiments, the reselection system of the gaming device further includes means for substituting a non-active reel for an active reel from the second game, thereby designating a new set of active reels for a third game. This new set of active reels for the third game includes a newly substituted active reel and remaining active reels. This embodiment also includes means for spinning, for the third game, the newly substituted active reel to achieve an outcome symbol while the remaining active reels are not spun. Additionally, this embodiment includes means for making a prize determination based upon the outcome symbol from the newly substituted active reel in conjunction with the outcome symbols from the remaining active reels, and awarding a prize, if appropriate, for the third game.

Another preferred embodiment is directed toward a gaming device that includes: a plurality of reels that are divided into a group of active reels and a group of inactive reels for an initial game, wherein each reel displays a symbol after being spun; means for spinning and subsequently stopping the active reels to determine whether a winning result has occurred in the initial game; means for substituting at least one inactive reel for at least one active reel from the initial game to create at least one newly active reel and remaining active reels for a second game; means for spinning and subsequently stopping the at least one newly active reel for the second game; and means for combining the symbol displayed on the newly active reel along with the symbols displayed on the remaining active reels to determine whether a winning result has occurred in the second game; whereby the substitution and spinning of a newly active reel and determination of game results continues for each following game until a predetermined criteria has been satisfied.

In a preferred reel spinning gaming method, the method is implemented using a plurality of selectable reels having symbols thereon, wherein each selectable reel displays an outcome symbol after being spun. A player engages in multiple games, with each reel spin constituting a game. The method includes: selecting a subset of the plurality of selectable reels as initial active reels in an initial game; spinning the initial active reels to achieve an outcome symbol combination in the initial game; making a prize determination based upon the outcome symbol combination, and awarding a prize, if appropriate, in the initial game; substituting a non-active reel for an active reel from the initial game, thereby designating a new set of active reels for a second game, the new set of active reels for the second game including a newly substituted active reel and remaining active reels; spinning, for the second game, the newly substituted active reel to achieve an outcome symbol; and making a prize determination based upon the outcome symbol from the newly substituted active reel in conjunction with the outcome symbols from the remaining active reels, and awarding a prize, if appropriate, for the second game.

In some preferred embodiments, the gaming method further includes: substituting a non-active reel for an active reel from the second game, thereby designating a new set of active reels for a third game, the new set of active reels for the third game including a newly substituted active reel and remaining active reels; spinning, for the third game, the newly substituted active reel to achieve an outcome symbol while the remaining active reels are not spun; making a prize determination based upon the outcome symbol from the newly substituted active reel in conjunction with the outcome symbols from the remaining active reels, and awarding a prize, if appropriate, for the third game; and repeating the substituting, designating, and spinning of active reels, and the making of prize determinations of the outcome symbol combinations produced in association therewith, for any additional games to which the player is entitled.

Other features and advantages of the present invention will become apparent from the following detailed description, taken in conjunction with the accompanying drawings, which illustrate by way of example, the features of the claimed invention.

DETAILED DESCRIPTION OF THE PREFERRED EMBODIMENTS

A preferred embodiment reel spinning gaming device, constructed in accordance with the present invention uses a plurality of reels, some of which are designated as active reels and some of which are designated as non-active reels, to provide a player with the opportunity to play multiple consecutive games of slots, with each subsequent consecutive game utilizing a portion of the reel symbols from the outcome symbol combination of the previous game. After an initial game that utilizes an initial set of active reels, the gaming device begins a second game by substituting a previously non-active reel from the initial game for an active reel from the initial game, thereby designating a new set of active reels for the second game. This new set of active reels for the second game includes the newly substituted active reel and the remaining active reels. The newly substituted active reel is spun for the second game while the remaining active reels are not spun for the second game. The outcome symbol from the newly substituted active reel is used in conjunction with the outcome symbols from the remaining active reels to produce an outcome symbol combination for the second game. The prize controller then performs a prize determination for the second game.

In this manner, the gaming device provides a player with the opportunity to play subsequent consecutive games in an attempt to improve upon the outcome symbol combination of the previous game. Accordingly, the present invention creates and maintains more excitement to a player. For instance, after receiving a game result that includes an outcome symbol combination that constitutes a "near win" (i.e., one symbol away from a winning outcome symbol combination), the player still has the possibility of achieving a winning outcome symbol combination in a subsequent consecutive game.

Figure 1:
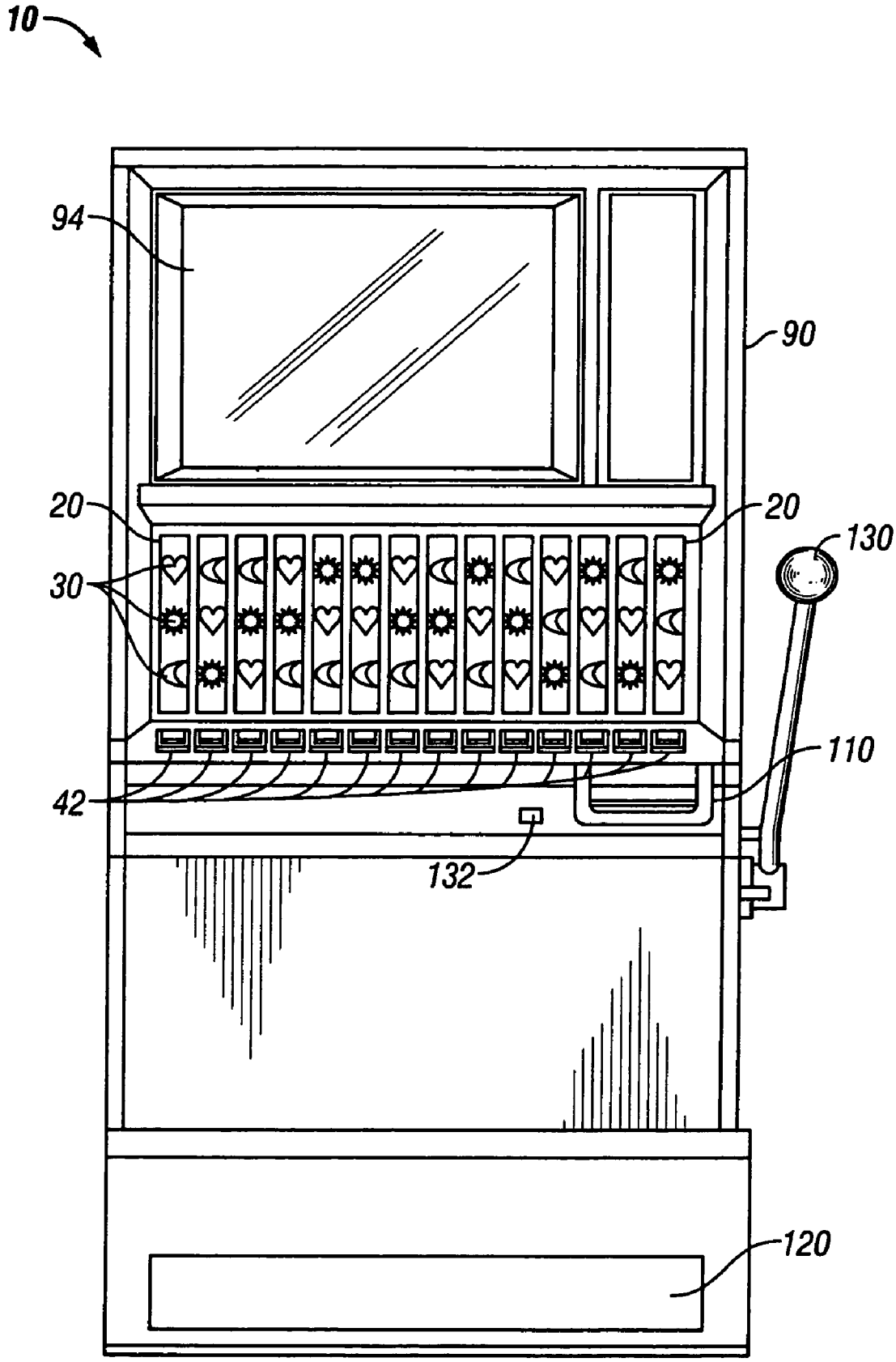
FIG. 1 illustrates a front view of a preferred embodiment, constructed in accordance with the present invention, having fourteen selectable reels and associated selection buttons, the selection buttons being used as part of a selection system and a reselection system.
Figure 2A:
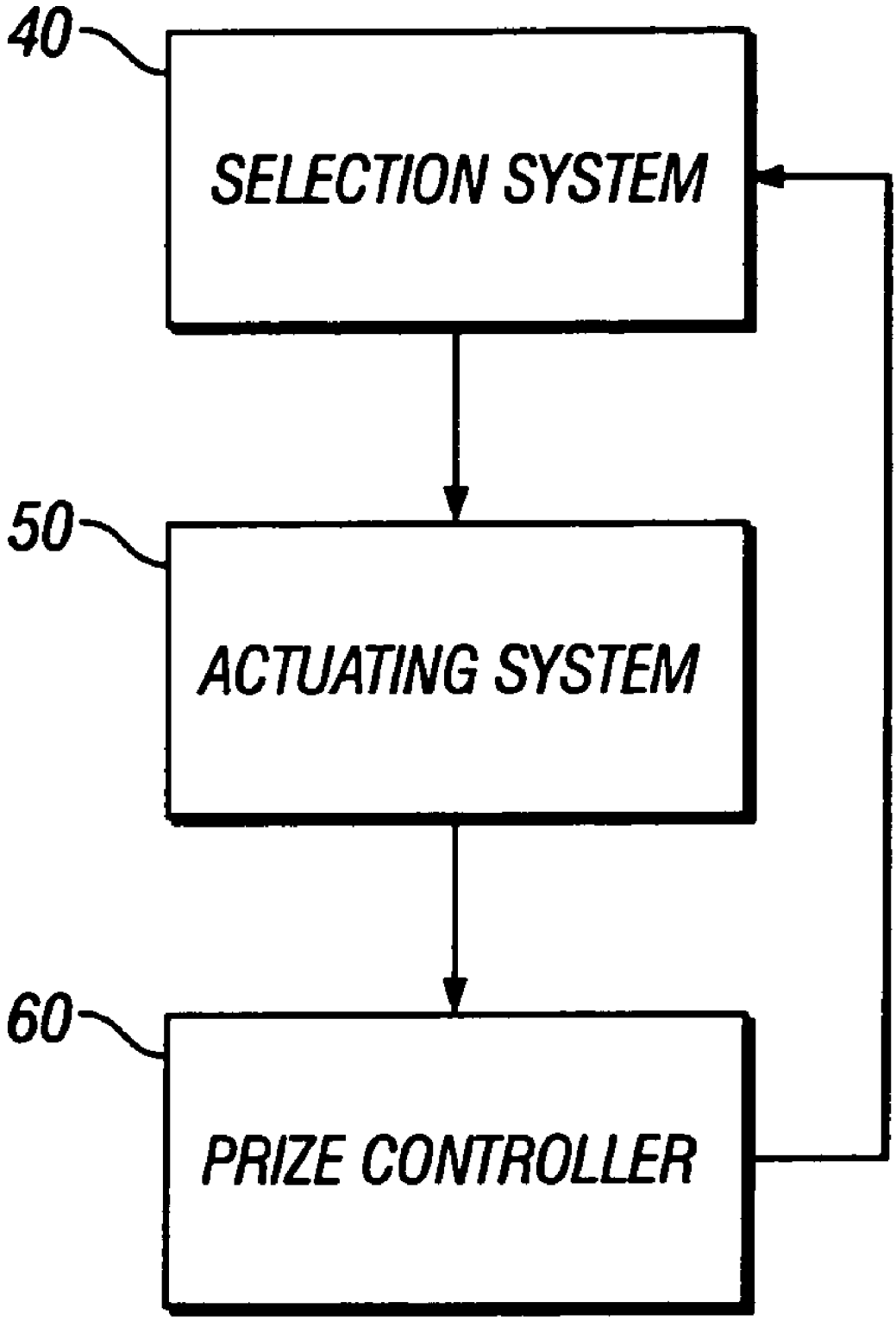
FIG. 2A illustrates a relational flow of a preferred method, showing the interaction of a selection system, an actuating system, and a prize controller.
Figure 3:
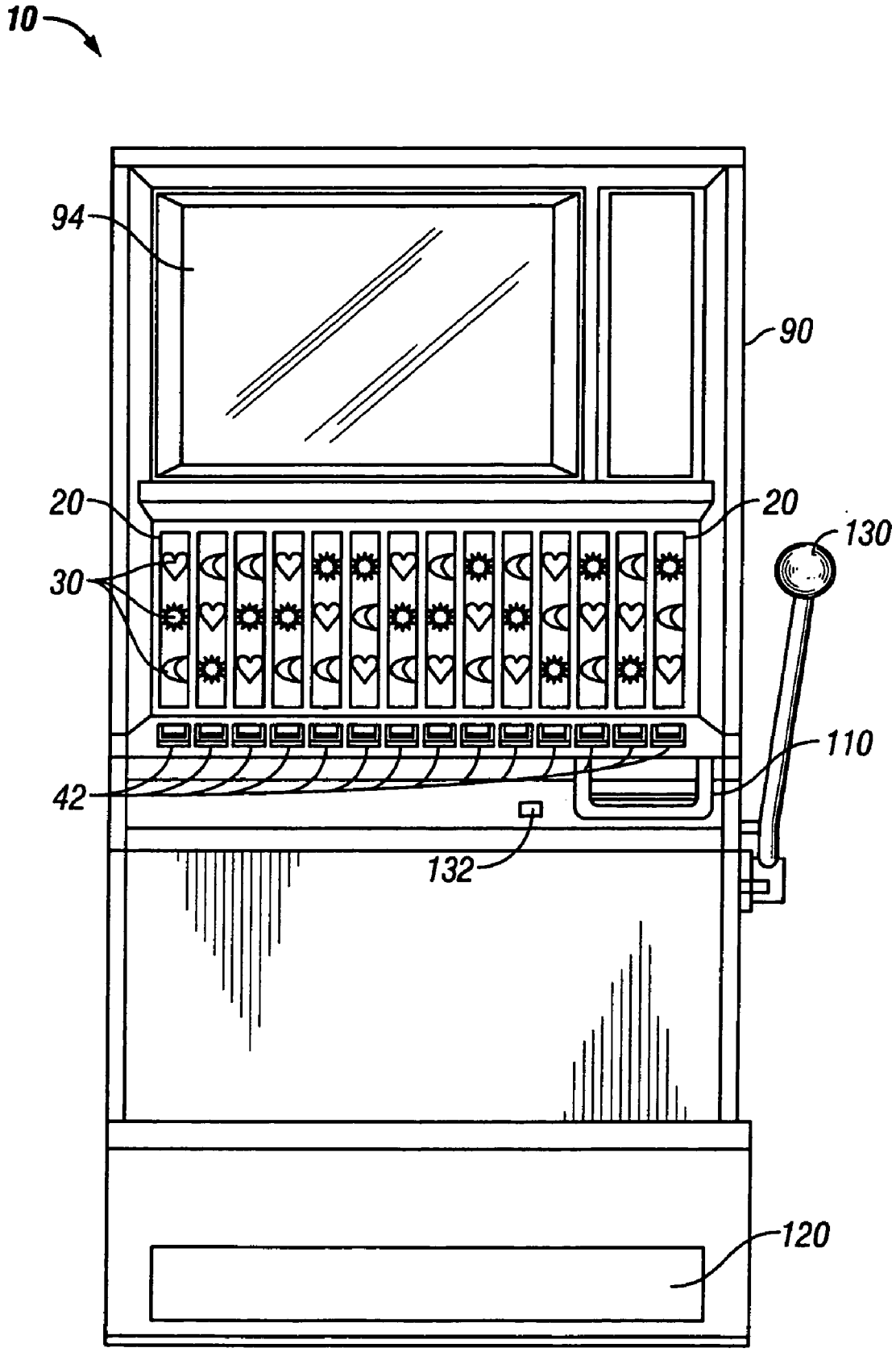
FIG. 3 illustrates a front view of the embodiment shown in FIG. 1, showing five of the selectable reels having been designated as active reels, as shown by the de-emphasizing of the non-active reels.

Referring now to the drawings, wherein like reference numerals denote like or corresponding parts throughout the drawings, and more particularly to FIGS. 1 and 3, there is shown a preferred reel spinning gaming device 10. Briefly stated, a preferred embodiment gaming device 10 includes a plurality of selectable reels 20 each having game symbols located thereon, a selection system 40, an actuating system 50, and a prize controller 60. Each reel 20 displays an outcome symbol 30 after having been spun. The number of selectable reels 20 included in the gaming device 10 is greater than that utilized for an individual game. In this regard, as shown in FIG. 2A, the selection system 40 designates a subset of the selectable reels 20 as the initial active reels 70 for the initial game. The actuating system 50 then spins the initial active reels 70, after which the prize controller 60 determines whether or not a prize is to be awarded dependent upon the combination of the outcome symbols 30 from the initial active reels.

Figure 2B:
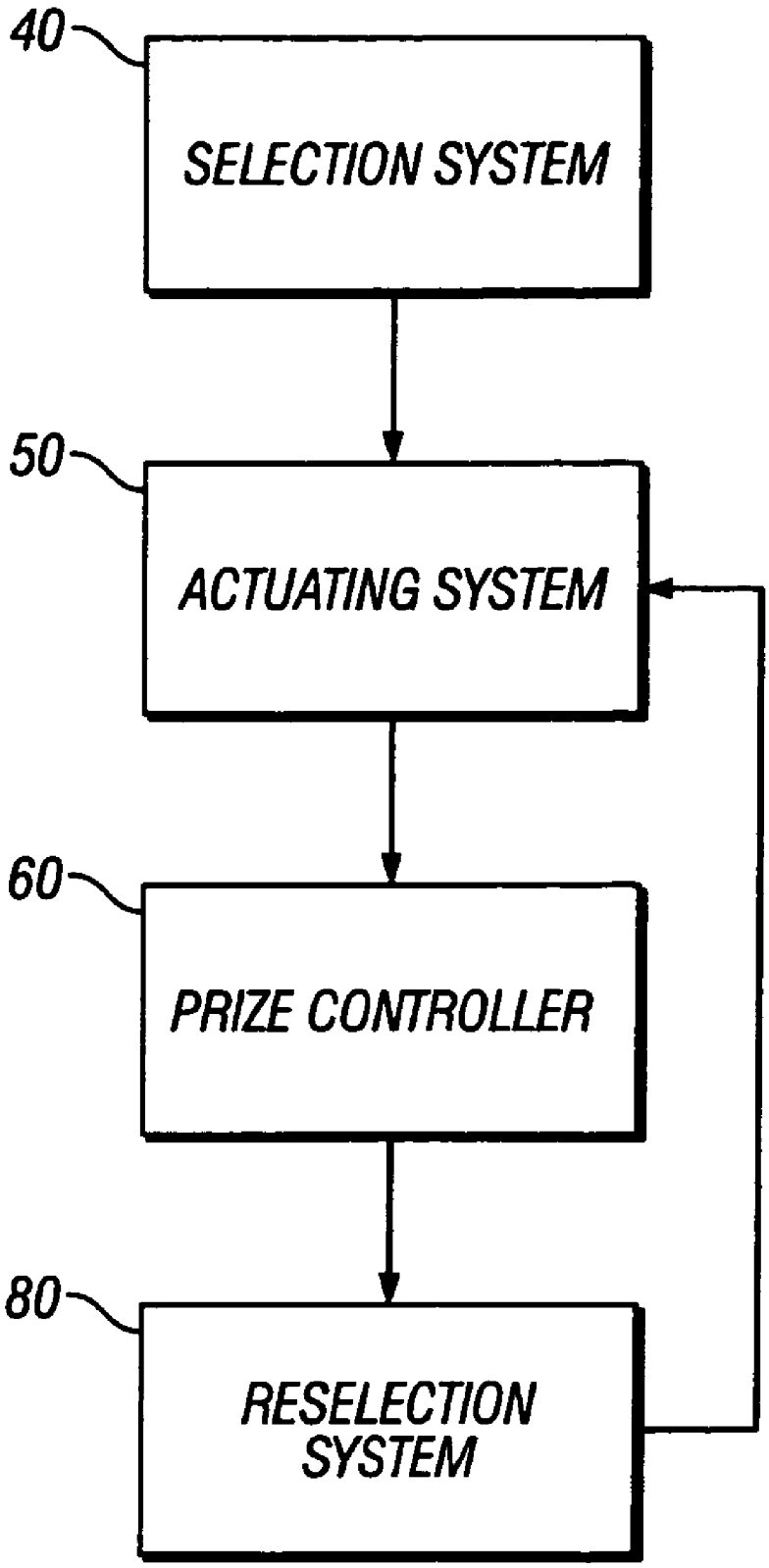
FIG. 2B illustrates a relational flow of a preferred method, showing the interaction of a selection system, an actuating system, a prize controller, and a reselection system.

The selection system 40 (or a reselection system 80 in some preferred embodiments, as shown in FIG. 2B) then designates a new subset of the selectable reels 20 as the active reels 70 for the second game by substituting a non-active reel from the initial game for an active reel from the initial game. Specifically, the active reels 70 for the second game include the newly substituted active reel and the remaining active reels from the initial game. The actuating system 50 then spins the newly substituted active reel, but does not spin the remaining active reels from the initial game. The prize controller 60 then determines whether or not a prize is to be awarded dependent upon the combination of the outcome symbol 30 from the newly substituted active reel and the outcome symbols of the remaining active reels from the initial game. This process is repeated for each subsequent consecutive game until all of the games purchased by the player (or otherwise entitled to the player) have been exhausted.

Figure 4:
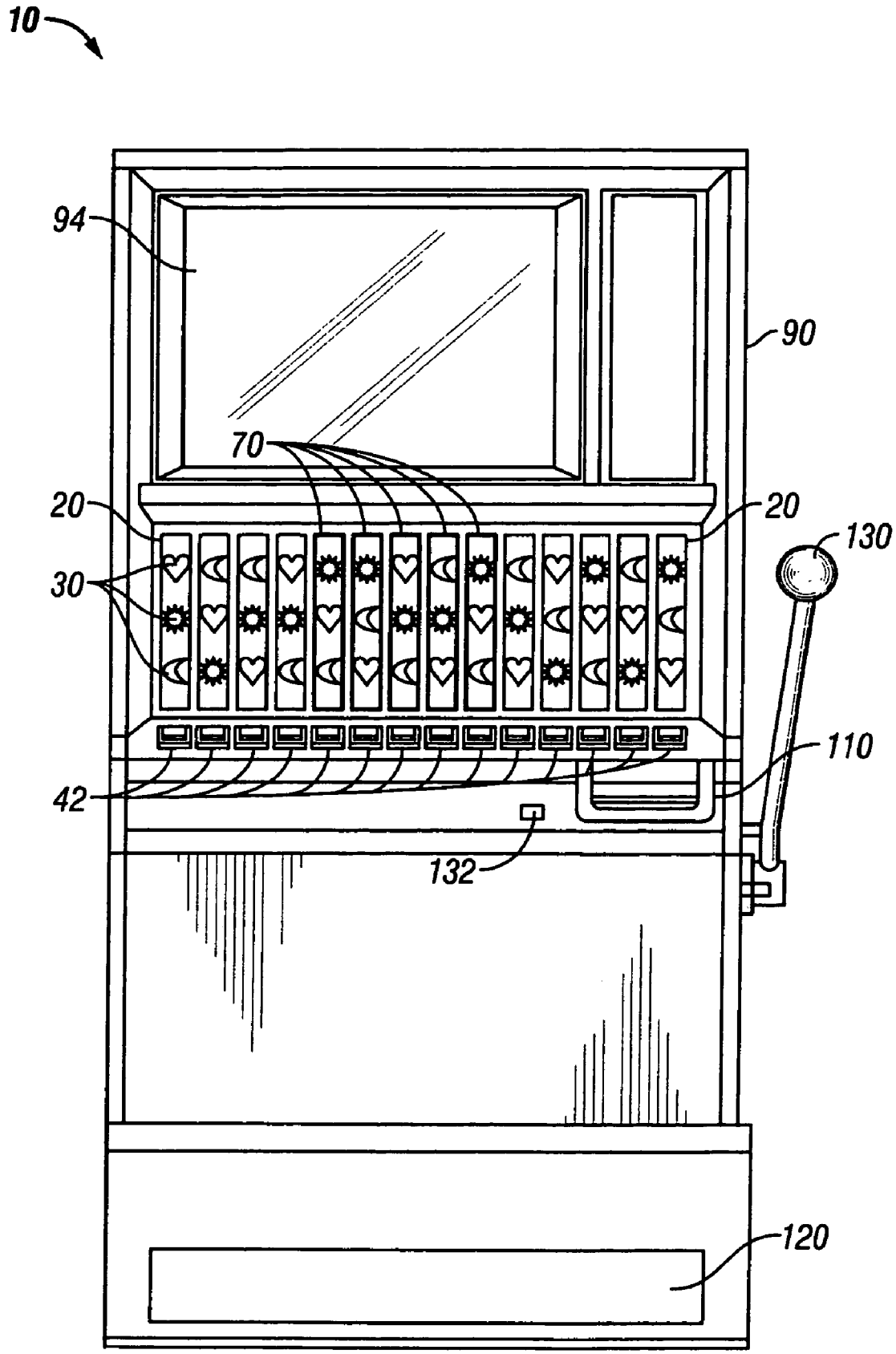
FIG. 4 illustrates a front view of the embodiment shown in FIG. 1, showing five of the selectable reels having been designated as active reels, as shown by the highlighting of the active reels.

More specifically, the reel spinning gaming device 10 of the present invention preferably includes fourteen selectable reels 20 housed inside a cabinet 90 that has a display window 94. In one preferred embodiment, as shown in FIGS. 3 and 4, five of the fourteen reels are designated as the active reels 70 for the initial game. Preferably, the game symbols are located on the periphery of each of the reels 20, and are used to determine the outcome of each individual game in which the reels were designated as active reels 70 (i.e., as outcome symbols 30). The outcome symbols 30 are visible on a pay line through the window 94. The outcome is determined from the combination of the outcome symbols 30 displayed by the active reels 70 on the pay line. It will be understood that gaming device 10 can also be constructed with a greater or lesser number of display reels 20. Further, a greater or lesser number of active reels 70 may be used.

Other preferred embodiments may utilize multiple pay lines, and thus, have more than one symbol position (outcome symbol 30) of each reel 20 visible at a time through the window 94. In another preferred embodiment, a video slot system may be used instead of the mechanical slot system described above. In still another preferred embodiment, a hybrid slot system may be used in which some of the reels in the slot machine are mechanical and some of the reels in the slot machine are produced by a video display.

In one preferred embodiment, selection buttons 42, which act as part of the selection system 40, are located in front of each selectable reel 20. The selection buttons 42 are used by a player to select which of the plurality of selectable reels 20 are to be designated as the active reels 70 for a particular game. The selection buttons 42 send signals within the selection system 40 that instruct the gaming device 10 which reels are active, and which reels are to be spun by the actuating system 50. Typically, at least part of the selection system 40 and the actuating system 50 are incorporated into a game microprocessor unit that is responsible for controlling game operations.

In one preferred embodiment, only the initial active reels 70 are spun by the actuating system 50 in the initial game, and only the newly substituted active reel is spun by the actuating system 50 in each subsequent consecutive game. Thus, the non-active reels are not typically spun by the actuating system 50 in the initial game, and both the non-active reels and the remaining active reels are not typically spun by the actuating system in each subsequent consecutive game. However, in other preferred embodiments, the non-active reels are also spun, in order to further increase player excitement by the "allure of what could have been," had other reels been selected as the initial active reels 70 or the newly substituted active reel. In such an embodiment, even though the non-active reels are spun by the actuating system 50, they are not used to determine whether or not a prize has been won.

Figure 5:
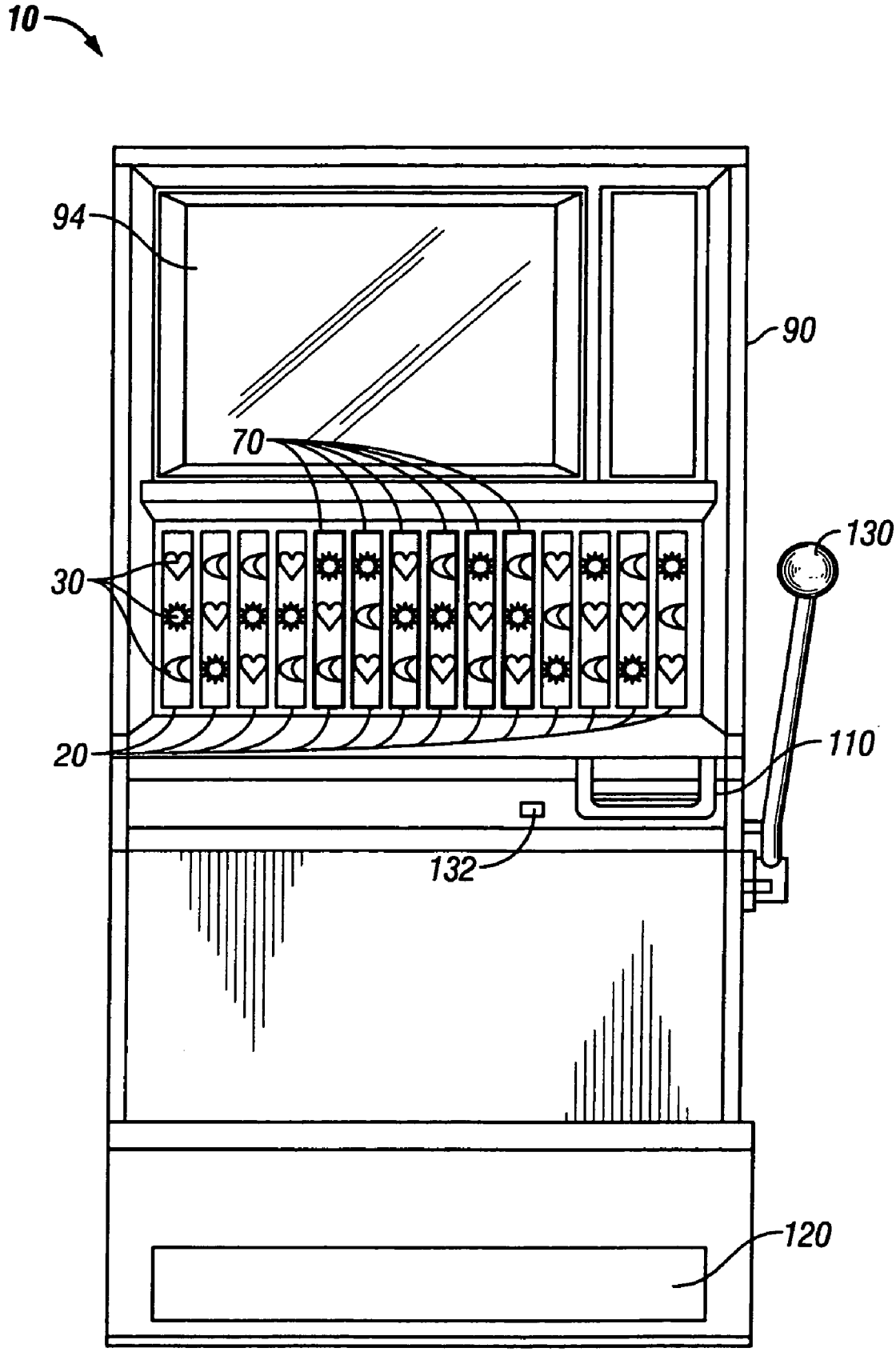
FIG. 5 illustrates a front view of a preferred embodiment, constructed in accordance with the present invention, having fourteen selectable reels and an associated touch screen, the touch screen being used as part of a selection system and a reselection system.

In another embodiment, as shown in FIG. 5, the selection system 40 incorporates touch screen technology that allows a player to select which of the plurality of selectable reels 20 are to be designated as the active reels 70 by touching a portion of the window 94 in front of the desired mechanical reels or video representation of reels. In still other embodiments, the selection system 40 automatically selects which of the plurality of selectable reels 20 are to be designated as the active reels 70, independent of player input.

In one exemplary embodiment, in accordance with conventional design, each selectable reel preferably includes a stepper motor that acts as part of the actuating system 50 to spin the reel. Each reel further includes an outer rim portion on which the game symbols are located. A mount secures and locates the stepper motor of each reel to the cabinet 90 such that one symbol, i.e., the outcome symbol 30, is visible through the window 94 on the pay line of the gaming device 10. The game microprocessor unit that controls the gaming operations is also located within the cabinet 90 of the gaming device 10. Either the game microprocessor unit, or the actuating system 50 itself, provides a drive signal to the stepper motors associated with the reels 20 that causes the reels to spin. In this manner, the actuating system 50 may be considered part of the game microprocessor unit in some configurations of the game device 10.

The game microprocessor unit also provides signals to the stepper motors associated with the reels 20 to cause the reels to halt in a particular position and to display outcome symbols 30 on the pay line that correspond to a particular outcome symbol combination (i.e., game result). The prize controller 60, which may also be incorporated as part of the game microprocessor unit, then determines whether or not a prize is to be awarded (i.e., makes a prize determination) dependent upon the outcome symbol combination of either the initial active reels 70 for the initial game or the newly substituted active reel and the remaining active reels for each subsequent consecutive game.

In accordance with conventional design, the gaming device 10 preferably also includes a coin slot 110 for receiving coins, a tray 120 for dispensing coins, and a user-actuated play handle 130 for initiating game play. A user-actuated play button 132 for initiating game play is typically also provided in order to appeal to varying player preferences. Within the cabinet 90, the gaming device 10 preferably includes a coin-dispensing unit of conventional design. To initiate play of the game, one or more coins are received through the coin slot 110 of the gaming device 10.

In some embodiments, a reselection system 80 is also included in the gaming device 10 and is used to select and substitute a previously non-active reel from the plurality of selectable reels 20 for a previously active reel from the group of active reels 70. The reselection system 80 then designates this new subset of reels as the active reels 70 for the next game. Specifically, the active reels 70 for the subsequent consecutive game include the next active reel and the remaining active reels from the previous game. The actuating system 50 then spins the newly substituted active reel, but does not spin the remaining active reels from the previous game. The prize controller 60 then awards a prize dependent upon the combination of the outcome symbol 30 from the newly substituted active reel and the outcome symbols 30 from the previously spun remaining active reels. This process is repeated until all of the subsequent consecutive games purchased by the player (or otherwise entitled to the player) have been exhausted.

Figure 6:
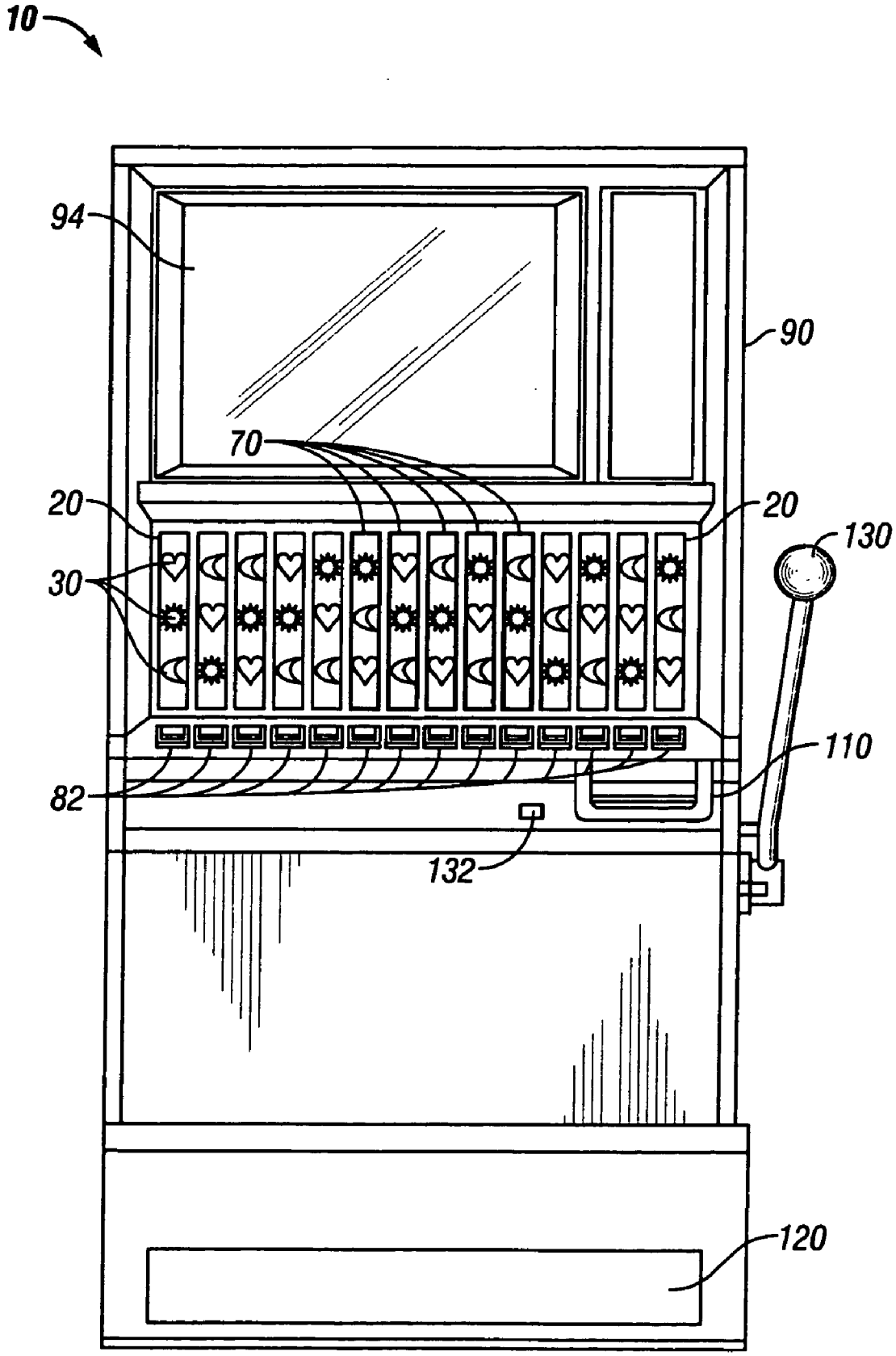
FIG. 6 illustrates a front view of the embodiment shown in FIG. 4, showing the rightmost active reel having become non-active, and a new previously non-active reel having been added to the left end of the remaining active reels, as shown by the highlighting of the active reels.
Figure 7:
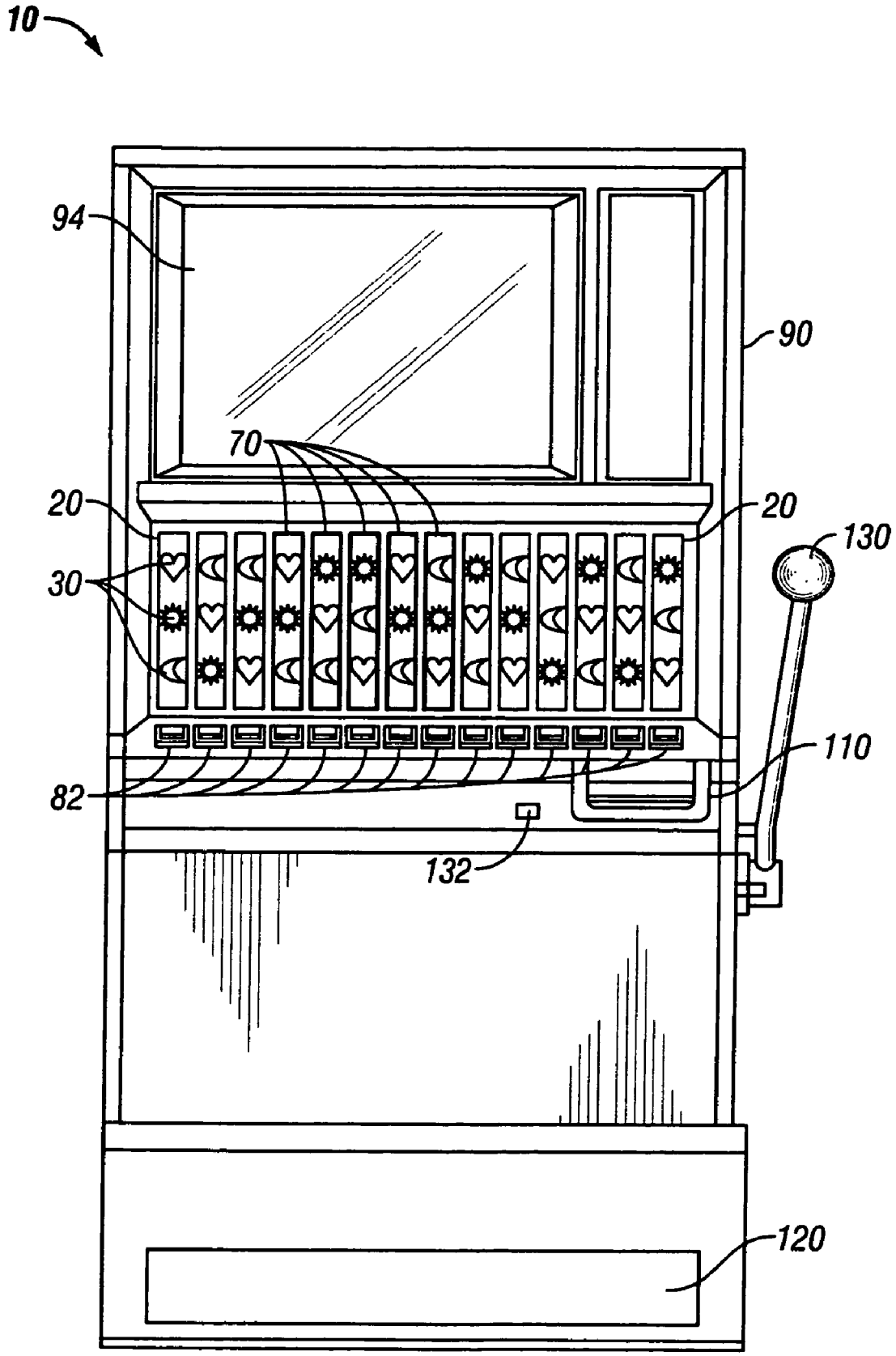
FIG. 7 illustrates a front view of the embodiment shown in FIG. 4, showing the leftmost active reel having become non-active, and a new previously non-active reel having been added to the right end of the remaining active reels, as shown by the highlighting of the active reels.
Figure 8:
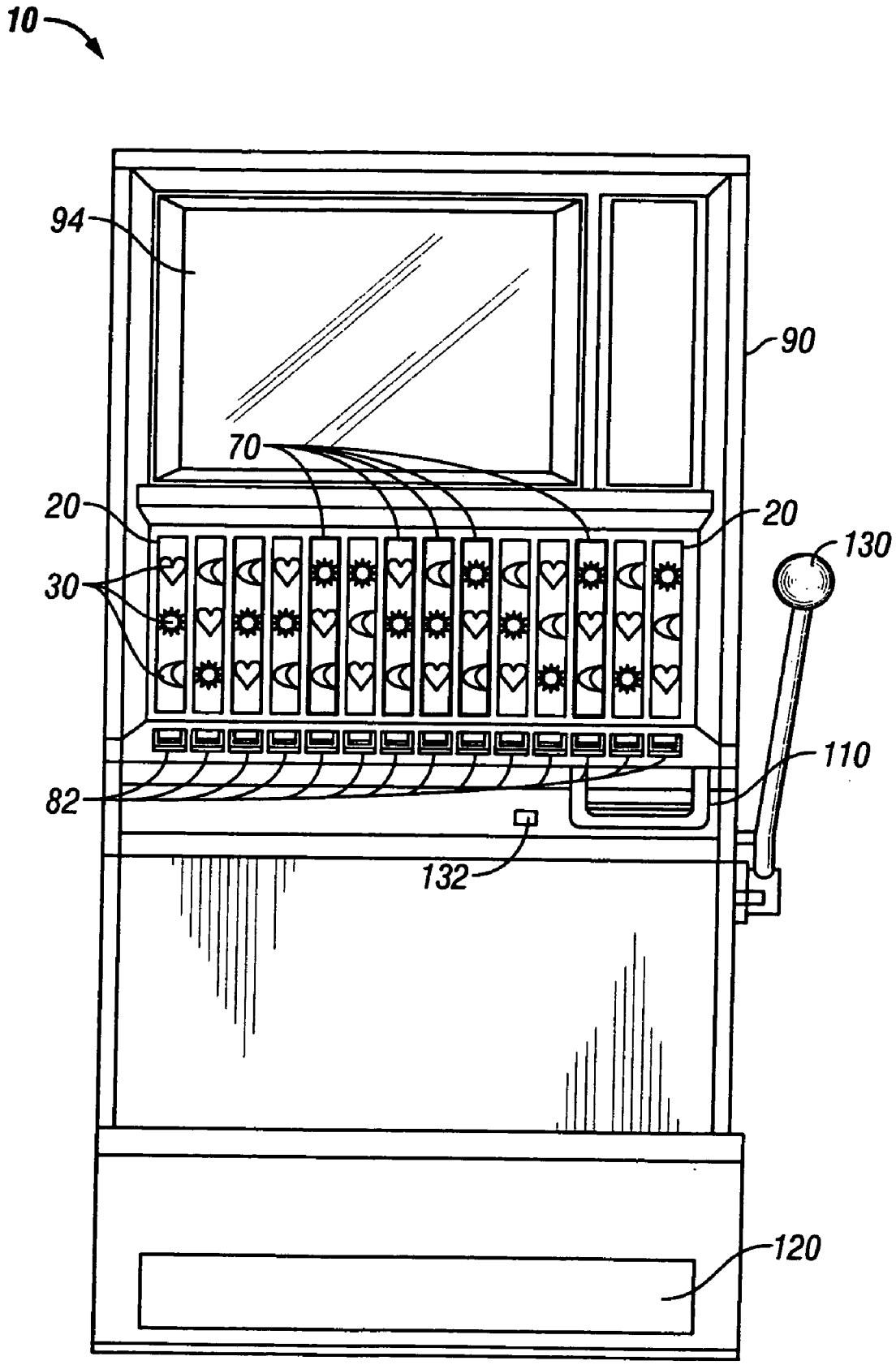
FIG. 8 illustrates a front view of the embodiment shown in FIG. 3, showing a randomly selected active reel having become non-active, and a new previously non-active and non-contiguous reel having been added to the remaining active reels, as shown by the highlighting of the active reels.

In one preferred embodiment, the reselection system 80 includes reselection buttons 82 that are located in front of each selectable reel 20. As shown in FIGS. 6–8, the reselection buttons 82 may be the same buttons that are used as the selection buttons 42 in some preferred embodiments. The reselection buttons 82 allow a player to select which non-active reel from the plurality of selectable reels 20 is to be designated as a newly substituted active reel for each subsequent consecutive game. The reselection buttons 82 send signals to the selection system 80 to instruct the gaming device 10 which reel is designated as the newly substituted active reel and is to be spun by the actuating system 50. In other preferred embodiments, the selection system 40 functions as both the selection system 40 and the reselection system 80, thereby removing the need for an independent reselection system 80.

Similar to selection system 40 discussed above with respect to FIG. 5, in other embodiments the reselection system 80 incorporates touch screen technology that allows a player to select which non-active reel from the plurality of selectable reels 20 is to be designated as a newly substituted active reel for each subsequent consecutive game. This is accomplished by touching the portion of the window 94 in front of the desired mechanical reel or video representation of a reel. In still other embodiments, the reselection system 80 automatically selects one of the selectable reels 20 to be designated as a newly substituted active reel for each subsequent consecutive game (and which active reel is to become non-active), independent of player input.

As shown in FIG. 6, in a preferred embodiment that incorporates an automatic reselection system, the active reels shift to the left by one reel each game, such that one active reel becomes non-active while a new, previously non-active reel becomes active at the other end. In one embodiment, the starting positions of the active reels within the total set of reels is preferably at the right end of the reels (in order to allow for the maximum number of reel shifts to the left); however, the starting positions of the active reels within the total set of reels varies between preferred embodiments.

As shown in FIG. 7, in another preferred embodiment that incorporates an automatic reselection system, the reels shift to the right by one reel (instead of to the left) each game, such that one active reel becomes non-active while a new, previously non-active reel becomes active at the other end. In one embodiment, the starting positions of the active reels within the total set of reels is preferably at the left end of the reels (in order to allow for the maximum number of reel shifts to the right); however, the starting positions of the active reels within the total set of reels varies between preferred embodiments.

In still other preferred embodiments, as shown by either FIG. 6 or 7, the direction of the reel shifting is completely random, such that one randomly selected active reel becomes non-active at of one end of the reels, while a new, randomly selected, previously non-active reel becomes active to the other end of the reels. In yet another preferred embodiment, as shown in FIG. 8, one active reel that is randomly selected from amongst the group becomes non-active (not necessarily from the one of the ends), while a new, randomly selected, previously non-active reel becomes active (also not necessarily at one of the ends); thus, resulting in a new group of active reels that may not be contiguous.

In other preferred embodiments, either a greater or lesser number of reels may be designated as the active reels 70. In another aspect of a preferred embodiment, a greater number of reels may be substituted and replaced as the active reels between each game. In still another aspect, the active reels 70 are designated as active by using one of several different techniques. In one such embodiment the active reels 70 are designated as active by highlighting at least a portion of the active reels, as shown in FIGS. 4 and 6–8. In another such embodiment, the active reels 70 are designated as active by de-emphasizing at least a portion of the non-active reels, as shown in FIG. 3. Such de-emphasizing can be achieved by shading or any other known technique. Finally, in yet another embodiment, the active reels 70 are designated as active by covering or otherwise eliminating at least a portion of the non-active reels from the player's view.

In one preferred embodiment, continuing in accordance with conventional design, game control circuits receive signals from a conventional coin-in detector and a conventional spin switch, which may be either a user-actuated play button switch 132, as described above, or a user-actuated play handle switch 130, as described above. The game microprocessor unit, utilizing a stored random number-generating algorithm, generates a random number. This number is applied to a memory device, preferably taking the form of a plug-in EPROM, in which a look-up table has been stored. In additional embodiments, CD-ROMs or other memory devices may also be used. The prize control unit 60 utilizes this number in conjunction with the stored look-up table in an EPROM or other memory device to select a game result. The look-up table contains a specific game result in the form of a game symbol to be displayed (blank, 7, bar, double bar, triple bar, or cherry) for each reel and for each applied random number. In this manner, the general functionality of a typical reel spinning slot machine is implemented in accordance with a preferred embodiment.

An example of a preferred reel spinning gaming device 10 is now described in operation. First, the gaming device 10 accepts a wager from a player to purchase game play, typically for multiple games. Next, a subset of the plurality of selectable reels 20 is selected as the active reels 70 for the initial game. When activated, these designated selectable reels (i.e., the active reels 70) begin to spin and at some point thereafter are subsequently stopped, thus producing a game result that is determined by the combination of the outcome symbols 30 displayed by the active reels along the pay line. The prize control unit 60 then awards a prize if a winning outcome symbol combination has been attained. This concludes the initial game of the present invention; however, subsequent consecutive games that utilize a portion of the outcome symbol combination from the initial game usually continue since a player typically engages in multiple consecutive games until all of the games that the player has wagered for (or is otherwise entitled to) have been exhausted.

If the player has provided a sufficient wager, game play continues with a first subsequent consecutive game (i.e., the second game). In the first subsequent consecutive game one of the active reels from the initial game is substituted for one of the non-active reels from the initial game. This newly substituted active reel, which was a non-active reel in the initial game, is then designated as an active reel for the second game, along with the remaining active reels from the initial game. The newly substituted active reel is then spun, and subsequently stopped to display an outcome symbol 30 along the pay line. The remaining active reels are not spun at this time. The outcome symbol 30 from the newly substituted active reel is used in conjunction with the outcome symbols 30 from the initial game displayed by the remaining active reels, in order to produce an outcome symbol combination that determines the game result for the second game. The prize control unit 60 then awards a prize for any new wins from this new outcome symbol combination for the second game. This concludes the second individual game; however, as described above, subsequent consecutive games that utilize a portion of the outcome symbol combination from the previous game continue until all of the multiple games that the player has wagered for (or is otherwise entitled to) have been exhausted.

If the player has provided a sufficient wager, game play continues with the next subsequent consecutive game (i.e. the third game). In the next subsequent consecutive game, one of the active reels from the second game is substituted for one of the non-active reels from the second game. This newly substituted active reel, which was a non-active reel in the second game, is then designated as an active reel for the third game, along with the remaining active reels from the second game. The newly substituted active reel is then spun and subsequently stopped to display an outcome symbol 30 along the pay line. The remaining active reels are not spun at this time. The outcome symbol 30 from the newly substituted active reel is used in conjunction with the outcome symbols 30 from the previously spun remaining active reels, in order to produce an outcome symbol combination that determines the game result for the third game. The prize control unit 60 then awards a prize for any new wins from this new outcome symbol combination for the third game. This concludes the third individual game; however, as described above, this substitution, spinning, and awarding process is repeated sequentially, based upon the active reels for each individual game, until all of the multiple games that the player has wagered for (or that the player is otherwise entitled to) have been exhausted.

In one exemplary embodiment, a gaming device has fourteen selectable reels numbered one through fourteen. An initial game is a played by spinning reels one through five, which are designated as the initial active reels in the first game. The prize controller makes a prize determination as to whether a prize is to be awarded based upon the outcome symbols of the initial active reels in the first game. The second game then begins in which reel number one becomes a non-active reel, reel number six becomes a newly substituted active reel, and reels two through five become the remaining active reels for the second game. The newly substituted active reel (i.e., reel six) is spun in the second game while the remaining active reels (i.e., reels two through five) are not spun in the second game. The prize controller makes a prize determination as to whether a prize is to be awarded based upon the outcome symbol from the newly substituted active reel (i.e., reel six) that was just spun in the second game and outcome symbols from the remaining active reels (i.e., reels two through five) that were not spun in the second game.

Following this same example, the third game then begins in which reel number two becomes a non-active reel, reel number seven becomes a newly substituted active reel, and reels three through six become the remaining active reels for the third game. The newly substituted active reel (i.e., reel seven) is spun in the third game while the remaining active reels (i.e., reels three through six) are not spun in the third game. The prize controller makes a prize determination as to whether a prize is to be awarded based upon the outcome symbol from newly substituted active reel (i.e., reel seven) that was just spun in the third game and the outcome symbols from the remaining active reels (i.e., reels three through six) that were not spun in the third game. This process is repeated for any additional games until a predetermined criteria has been satisfied or until all games purchased by the player have been played.

Furthermore, the various methodologies described above are provided by way of illustration only and should not be construed to limit the invention. Those skilled in the art will readily recognize various modifications and changes may be made to the present invention without departing from the true spirit and scope of the present invention. Accordingly, it is not intended that the invention be limited, except as by the appended claims.

What is claimed is:

1. A game system that allows a player to play multiple games, wherein each actuation of reels constitutes a game, the system comprising:

a plurality of selectable reels, wherein each selectable reel displays an outcome symbol after the reel has been actuated;

a selection system operatively associated with each selectable reel, wherein the selection system designates a subset of the selectable reels as the initial active reels for an initial game;

an actuating system operatively associated with the selectable reels, wherein the actuating system actuates the initial active reels to achieve an outcome symbol combination for the initial game;

a prize controller, wherein the prize controller makes a prize determination as to whether a prize is to be awarded based upon the outcome symbol combination of the initial game; and a reselection system, wherein the reselection system substitutes a non-active reel for an active reel from the initial game, thereby designating a new set of active reels for a second game, the new set of active reels for the second game including a newly substituted active reel and remaining active reels, and wherein the newly substituted active reel is actuated for the second game while the remaining active reels are not actuated for the second game;

wherein the active reels are designated as active by de-emphasizing at least a portion of the non-active reels; and wherein the outcome symbol from the newly substituted active reel is used in conjunction with the outcome symbol from the remaining active reels to produce an outcome symbol combination for the second game, and wherein the prize controller performs a prize determination for the second game.

2. The gaming system of claim 1, wherein the reselection system further substitutes a non-active reel for an active reel from the second game, thereby designating a new set of active reels for a third game, the new set of active reels for the third game including a newly substituted active reel and remaining active reels, and wherein the newly substituted active reel is actuated for the third game while the remaining active reels are not actuated;

wherein the outcome symbol from the newly substituted active reel is used in conjunction with the outcome symbol from the remaining active reels to produce an outcome symbol combination for the third game, and wherein a prize determination is performed by the prize controller for the third game; and wherein the substitution, designation, and actuation of active reels, and the prize determination of the outcome symbol combinations produced in association therewith, is repeated for any additional games until a pre-established criteria has been satisfied.

3. The gaming system of claim 1, wherein the reselection system substitutes more than one non-active reel for more than one active reel when designating a new subset of the selectable reels as active reels.

4. The gaming system of claim 1, wherein the substitution of a non-active reel for an active reel comprises shifting the selectable reels that are designated as active reels to the left by one reel within the plurality of selectable reels.

5. The gaming system of claim 1, wherein the substitution of a non-active reel for an active reel comprises shifting the selectable reels that are designated as active reels to the right by one reel within the plurality of selectable reels.

6. The gaming system of claim 1, wherein the substitution of a non-active reel for an active reel comprises randomly selecting the reels that are to be designated as active reels within the plurality of selectable reels.

7. The gaming system of claim 1, wherein the reselection system that substitutes non-active reels for active reels is player controlled.

8. The gaming system of claim 1, wherein the reselection system that substitutes non-active reels for active reels is computer controlled.

9. The gaming system of claim 1, wherein the selectable reels are mechanical components.

10. The gaming system of claim 1, wherein the selectable reels are video components.

11. The gaming system of claim 1, wherein the selectable reels include both mechanical and video reels.

12. The gaming system of claim 1, wherein the active reels are designated as active by highlighting the active reels.

13. The gaming system of claim 1, wherein the active reels are designated as active by de-emphasizing the non-active reels.

14. The gaming system of claim 1, wherein the active reels are designated as active by removing the non-active reels from view of the player.

15. The gaming system of claim 1, wherein the active reels are juxtapositioned within the plurality of selectable reels.

16. The gaming system of claim 1, wherein the active reels are non-contiguous within the plurality of selectable reels.

17. The gaming system of claim 1, wherein only the initial active reels are actuated in the initial game, and wherein only the newly substituted active reel that is so designated in each following game is actuated in that following game.

18. The gaming system of claim 1, wherein all of the plurality of selectable reels are actuated in the initial game for increased player excitement, but only the outcome symbol combination from the initial active reels is used by the prize controller to provide a prize determination for the initial game; and wherein all of the plurality of selectable reels, except for the remaining active reels, are actuated in the second game for increased player excitement, but only the outcome symbol from the newly substituted active reel in conjunction with outcome symbol from the remaining active reels are used by the prize controller to provide a prize determination for the second game.

19. A gaming system that allows a player to play multiple games, wherein each actuation of the reels constitutes a game, the system comprising:

a plurality of selectable reels, wherein each selectable reel displays an outcome symbol after the reel has been actuated;

a selection system operatively associated with each selectable reel, wherein the selection system designates a subset of the selectable reels as the initial active reels for the initial game, and wherein, for a second game, the selection system substitutes a non-active reel with an active reel from the initial game, thereby designating a new set of active reels for the second game, the new set of active reels for the second game including a newly substituted active reel and remaining active reels;

an actuating system operatively associated with the selectable reels, wherein the actuating system actuates the initial active reels to achieve an outcome symbol combination for the initial game; and wherein the actuating system actuates the newly substituted active reel in the second game to achieve an outcome symbol while not actuating the remaining active reels in the second game; and wherein the outcome symbol from the newly substituted active reel in the second game is used in conjunction with the outcome symbol from the remaining active reels to produce an outcome symbol combination for the second game; and wherein the active reels are designated as active by de-emphasizing at least a portion of the non-active reels; and a prize controller, wherein the prize controller makes a prize determination as to whether a prize is to be awarded based upon the outcome symbol combination of each game.

20. The gaming system of claim 19, wherein the substitution, designation, and actuation of active reels, and the prize determination of the outcome symbol combinations produced in association therewith, is repeated for any additional games to which the player is entitled.

21. A gaming method implementing a plurality of selectable reels, wherein each selectable reel displays an outcome symbol after the reel has been actuated, and wherein a player engages in multiple games, each actuation of the reels constituting a game, the method comprising:

selecting a subset of the plurality of selectable reels as initial active reels in an initial game, wherein the active reels are designated as active by de-emphasizing at least a portion of the non-active reels; and actuating the initial active reels to achieve an outcome symbol combination in the initial game;

making a prize determination based upon the outcome symbol combination, and awarding a prize, if appropriate, in the initial game;

substituting a non-active reel for an active reel from the initial game, thereby designating a new set of active reels for a second game, the new set of active reels for the second game including a newly substituted active reel and remaining active reels;

actuating, for the second game, the newly substituted active reel to achieve an outcome symbol; and making a prize determination based upon the outcome symbol from the newly substituted active reel in conjunction with the outcome symbol from the remaining active reels, and awarding a prize, if appropriate, for the second game.

22. The method of claim 21, further comprising:

substituting a non-active reel for an active reel from the second game, thereby designating a new set of active reels for a third game, the new set of active reels for the third game including a newly substituted active reel and remaining active reels;

actuating, for the third game, the newly substituted active reel to achieve an outcome symbol while the remaining active reels are not actuated;

making a prize determination based upon the outcome symbol from the newly substituted active reel in conjunction with the outcome symbol from the remaining active reels, and awarding a prize, if appropriate, for the third game; and repeating the substituting, designating, and actuating of active reels, and the making of prize determinations of the outcome symbol combinations produced in association therewith, for any additional games to which the player is entitled.

23. The method of claim 21, wherein the substituting of non-active reels with active reels comprises substituting more than one non-active reel with more than one active reel, thereby designating a larger number of newly substituted active reels and a smaller number of remaining active reels for a subsequent consecutive game.

24. The method of claim 21, wherein the substituting of reels comprises shifting the reels that are designated as active reels to the left by one reel within the plurality of selectable reels.

25. The method of claim 21, wherein the substituting of reels comprises shifting the reels that are designated as active reels to the right by one reel within the plurality of selectable reels.

26. The method of claim 21, wherein the substituting of reels comprises randomly selecting the reels that are to be designated as active reels within the plurality of selectable reels.

27. The method of claim 21, wherein the substituting of a non-active reel with an active reel is player controlled.

28. The method of claim 21, wherein the substituting of a non-active reel with an active reel is computer controlled.

29. The method of claim 21 wherein the selectable reels are mechanical components.

30. The method of claim 21, wherein the selectable reels are video components.

31. The method of claim 21, wherein the selectable reels include both mechanical and video reels.

32. The method of claim 21, wherein the active reels are designated as active by highlighting at least a portion of the active reels.

33. The method of claim 21, wherein the active reels are designated as active by de-emphasizing the non-active reels.

34. The method of claim 21, wherein the active reels are designated as active by concealing the non-active reels from the player's view.

35. The method of claim 21, wherein the active reels are juxtapositioned within the plurality of selectable reels.

36. The method of claim 21, wherein the active reels are non-contiguous within the plurality of selectable reels.

37. The method of claim 21, wherein only the initial active reels are actuated in the initial game, and wherein only the newly substituted active reel that is so designated in each following game is actuated in that following game.

38. The method of claim 21, wherein all of the plurality of selectable reels are actuated in the initial game for increased player excitement, but only the outcome symbol combination from the initial active reels is used by the prize controller to make a prize determination; and wherein all of the plurality of selectable reels except for the remaining active reels are actuated in the second game for increased player excitement, but only the outcome symbol from the newly substituted active reel in conjunction with outcome symbol from the remaining active reels are used by the prize controller to make a prize determination for the second game.

39. A gaming system, the system comprising:

a plurality of selectable reels having symbol thereon, wherein each selectable reel displays an outcome symbol after the reel has been actuated;

means for accepting a wager from a player to purchase game play, wherein each actuation of a reel constitutes a game;

means for selecting a subset of the plurality of selectable reels as initial active reels in an initial game;

means for actuating the initial active reels to achieve an outcome symbol combination in the initial game;

means for making a prize determination based upon the outcome symbol combination, and awarding a prize, if appropriate, in the initial game;

means for substituting a non-active reel for an active reel from the initial game, thereby designating a new set of active reels for a second game, the new set of active reels for the second game including a newly substituted active reel and remaining active reels;

means for actuating, for the second game, the newly substituted active reel to achieve an outcome symbol; and means for making a prize determination based upon the outcome symbol from the newly substituted active reel in conjunction with the outcome symbol from the remaining active reels, and awarding a prize, if appropriate, in the second game.

40. The system of claim 39, further comprising:

means for substituting a non-active reel for an active reel from the second game, thereby designating a new set of active reels for a third game, the new set of active reels for the third game including a newly substituted active reel and remaining active reels;

means for actuating, for the third game, the newly substituted active reel to achieve an outcome symbol while the remaining active reels are not actuated; and means for making a prize determination based upon the outcome symbol from the newly substituted active reel in conjunction with the outcome symbol from the remaining active reels, and awarding a prize, if appropriate, for the third game.

41. A gaming system that allows a player to play multiple games, wherein each actuation of reels constitutes a game, the system comprising:

a plurality of selectable reels, wherein each selectable reel, displays an outcome symbol after the reel has been actuated;

a selection system operatively associated with each selectable reel, wherein the selection system designates a subset of the selectable reels as the initial active reels for an initial game;

an actuating system operatively associated with the selectable reels, wherein the actuating system actuates the initial active reels to achieve an outcome symbol combination for the initial game; and a reselection system, wherein the reselection system substitutes a non-active reel for an active reel from the initial game, thereby designating a new set of active reels for a second game, the new set of active reels for the second game including a newly substituted active reel and remaining active reels, and wherein the newly substituted active reel is actuated for the second game while the remaining active reels are not actuated for the second game;

wherein the active reels are designated as active by de-emphasizing at least a portion of the non-active reels; and wherein the outcome symbol from the newly substituted active reel is used in conjunction with the outcome symbol from the remaining active reels to produce an outcome symbol combination for the second game.

* * * * *